United States Patent [19]

Krulich

[11] Patent Number: 4,921,216

[45] Date of Patent: May 1, 1990

[54] STAPLE REMOVER

[76] Inventor: Ronald F. Krulich, 8945 Mystic La., Warren, Mich. 48093

[21] Appl. No.: 190,005

[22] Filed: May 4, 1988

[51] Int. Cl.[5] ..... B25C 11/00

[52] U.S. Cl. ..... 254/28

[58] Field of Search ..... 254/22, 28; 227/63

[56] References Cited

U.S. PATENT DOCUMENTS

| | | | |
|---|---|---|---|
| 2,549,260 | 4/1951 | Sudbury | 254/28 |
| 2,592,570 | 4/1952 | Hofstetter | 254/28 |
| 2,596,719 | 5/1952 | Paukonin | 254/28 |
| 2,624,545 | 1/1953 | Pankonin | 254/28 |

*Primary Examiner*—Judy Hartman
*Attorney, Agent, or Firm*—Peter D. Keefe

[57] ABSTRACT

A staple remover for removing staples from stapled materials utilizing an inclined plane in combination with a gripper. First and second jaws are provided, each have two jaw members. The two jaw members of the first jaw are spaced from each other just less than the width of a staple. The two jaw members of the second jaw are spaced from each other less than the spacing of the jaw members for the first jaw so that the second jaw may insert within the first jaw. The first and second jaws are connected together by a pivot and are resiliently biased in an open position. Each of the jaw members of the first and second jaws terminate in a pointed extremity. Each of the jaw members of the first and second jaws further have an upper and lower cam surface which smoothly diverge from each other rearwardly from the pointed extremity. The combination of the upper and lower cams of each jaw member form two parallel wedge shapes which are used as dual inclined planes to cause a staple to be separated from materials to which it is stapled. The jaw members of one of the jaws are each provided with a notch spaced from the aforesaid pointed extremity thereof. A staple is removed by squeezing the jaws together thereby forcing the pointed extremities to move under the staple, the inclined plane action of the upper and lower cams causing the staple to be partially released from the material to which it is stapled. Thereupon, the staple will encounter the aforesaid notches, causing the staple to be gripped by action of the cam surface of the non-notched jaw members of the other jaw, and allowing for final staple removal by pulling.

2 Claims, 1 Drawing Sheet

FIG.1
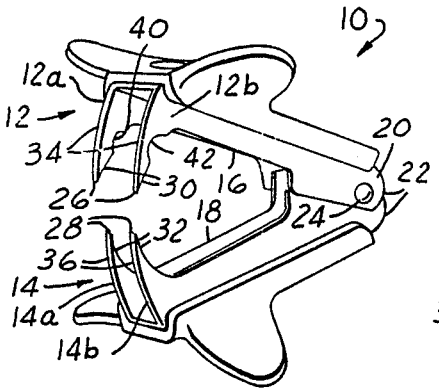
FIG.2
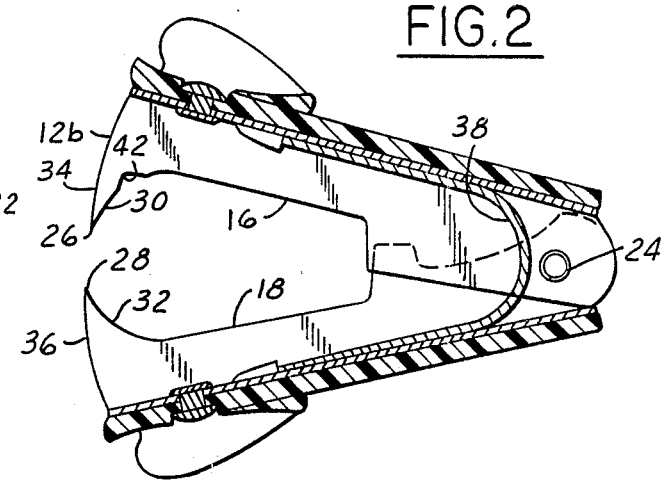
FIG.3
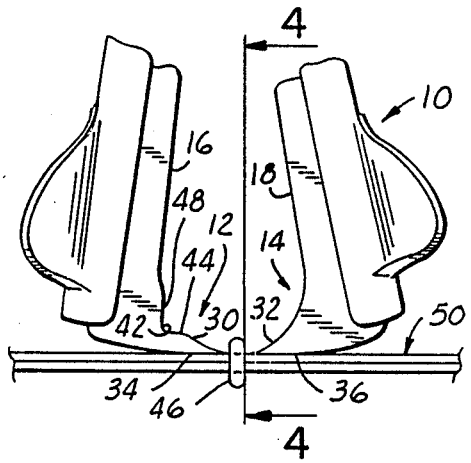
FIG.5
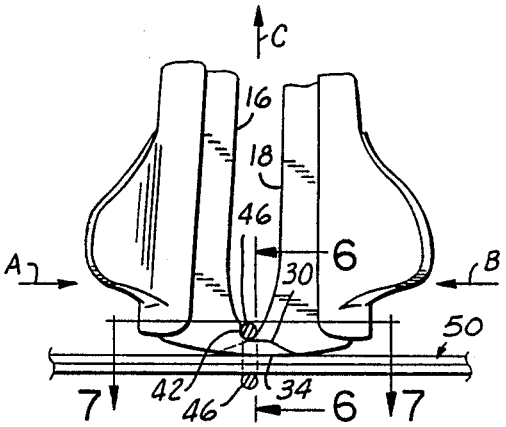
FIG.4
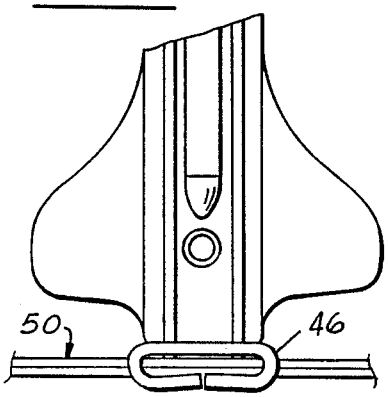
FIG.6
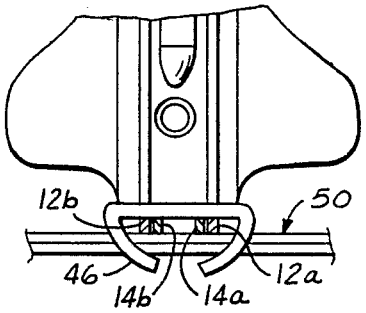
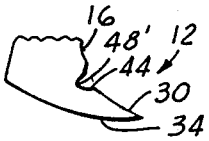
FIG.8
FIG.7
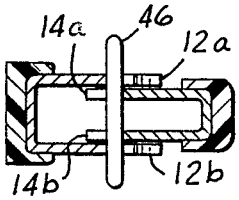

STAPLE REMOVER

BACKGROUND OF THE INVENTION

1. Field of the Invention

The present invention relates to devices which remove staples from stapled objects, and more particularly to a staple remover which removes staples by inclined plane action combined with gripper action.

2. Description of the Prior Art

Common staples are used most frequently to secure together sheets of paper. Frequently, especially in the building trades, staples are also used to secure materials, such as screening and shingling, to wood or other porous building materials. A problem arises when the materials which have been secured together by a staple or staples must now be unstapled so that the materials may be separated from each other.

One common solution, which has over the years become the industry standard, is described in U.S. Pat. No. 2,033,050 dated Mar. 3, 1936 to Pankonin. Pankonin utilizes a pair of jaws, a first and second, which are connected by a resilient bow section. Each of the jaws is of single piece construction, including two joined jaw members which are mutually spaced apart a distance just less than the width of an average staple. The first jaw has jaw members spaced slightly less apart than the jaw members of the second jaw so that the first jaw may be inserted between the jaw members of the second jaw. Each jaw member of the first and second jaws has a pointed extremity. Each jaw member further has an upper and a lower cam surface. The lower cam surface and the upper cam surface smoothly diverge away from each other rearwardly from the pointed extremity, thereby forming a wedge shape. In operation to remove a staple, when the jaws are squeezed together, the pointed extremities of the jaws are forced under the staple. The upper and lower cams act as an inclined plane at each end of the staple to force the staple away from the stapled paper as the jaws are further squeezed. Efficient and trouble free operation of Pankonin is dependent upon both anchored ends of the staple pulling out of the stapled object in synchroneity. However, as frequently happens during the process of squeezing the jaws together, one anchored end of the staple may pull out before the other, resulting in a total loss of inclined plane action on the staple. The user is then faced with the unpleasant task of somehow removing the staple while a substantial portion of the staple is still anchored in the stapled material.

Therefore, there remains in the art the need to devise a staple remover which utilizes an inclined plane action but further prevents one anchored end of the staple from pulling loose before the other, or, if one end should pull free first, provides for easy and efficient removal in any event.

SUMMARY OF THE INVENTION

The present invention provides for removal of staples from stapled materials utilizing an inclined plane in combination with a gripper.

First and second jaws are provided, each having two jaw members. The two jaw members of the first jaw are spaced from each other just less than the width of a staple. The two jaw members of the second jaw are spaced from each other less than the spacing of the jaw members for the first jaw so that the second jaw may be inserted between the jaw members of the first jaw. The first and second jaws are connected together by a pivot and are resiliently biased in an open position. Each of the jaw members of the first and second jaws terminate in a pointed extremity. Each of the jaw members of the first and second jaws further have an upper and lower cam surface in which the upper and lower cam surfaces smoothly diverge from each other rearwardly from the pointed extremity. The combination of the upper and lower cams of each jaw member form two parallel wedge shapes which are used as dual inclined planes to cause a staple to be separated from materials to which it is stapled. The jaw members of one of the jaws are each provided with a notch spaced from the aforesaid pointed extremity thereof.

In operation, a staple is removed by squeezing the jaws together thereby forcing the pointed extremities to move under the staple adjacent the anchored ends thereof, the inclined plane action of the upper and lower cams causing the staple to be partially released from the material to which it is stapled. Before the staple is freed from the material, the staple will move along the upper and lower cam surfaces and eventually encounter the aforesaid notch in each of the notched jaw members of one of the jaws. Thereupon the staple will be gripped by action of the cam surface of the non-notched jaw members of the other jaw, resulting in the staple being forced into the aforesaid notch in the notched jaw members. The user then simply pulls away from the material to cause release of the staple from the material. Should one end of the staple pull free first, the gripping action caused by the notch in the notched jaw member adjacent the remaining anchored end of the staple will allow the user to pull the anchored staple end free of the material without undue effort or strain.

Accordingly, it is an object of the present invention to provide a staple remover which provides both an inclined plane action and a gripping action for removing of staples from materials.

It is another object of the present invention to provide a staple remover which allows the user to easily remove a staple from a stapled material after one end of the staple has pulled free from the material.

It is a further object of the present invention to provide a method of removing a staple from a stapled material, in which the staple is initially broken free from the material by action of an inclined plane, then the staple is gripped by a pinching action of jaw members so that a pulling movement releases the staple from the material.

These, and additional objects, advantages, features and benefits of the present invention will become apparent from the following specification.

BRIEF DESCRIPTION OF THE DRAWING

FIG. 1 is a perspective view of the staple remover according to the present invention;

FIG. 2 is a part sectional side view of the staple remover of FIG. 1;

FIG. 3 is a side view of the staple remover of FIG. 1 shown about to be used to remove a staple from a material;

FIG. 4 is a side view of the staple remover shown along lines 4—4 in FIG. 3;

FIG. 5 is a side view of the staple remover of FIG. 1 shown removing a staple in which the staple is located in a notch according to the present invention;

FIG. 6 is a part sectional front view of the staple remover shown along lines 6—6 in FIG. 5;

FIG. 7 is a part sectional plan view of the staple remover shown along lines 7—7 in FIG. 5; and FIG. 8 is a detail view of an alternative notch according to the present invention, showing a second notch surface of concave shape.

DETAILED DESCRIPTION OF THE PREFERRED EMBODIMENT

Referring now to the figures, FIG. 1 shows the staple remover 10 according to the present invention. The staple remover 10 consists of two jaws, a first jaw 12 and a second jaw 14. Each of the first and second jaws is preferred to be constructed of a channel having a U-shape. The U-shape results in two jaw members for each of the first and second jaws 12*a*, 12*b* and 14*a*, 14*b*, respectively. The jaw members 12*a* and 12*b* of the first jaw 12 are separated from each other by a distance equal to just less than the width of a staple. The jaw members 14*a* and 14*b* of the second jaw 14 are separated from each other by a distance sufficient to permit them to be inserted between the jaw members 12*a* and 12*b* of the first jaw when the first and second jaws are squeezed together. Each of the first and second jaws have an integral extension member 16, 18, respectively, which extends in a direction generally perpendicularly in relation to the orientation of the jaw members. The first and second jaws are connected together at a pivot 20 located at the end 22 of each of the extension members and remote from the first and second jaws. A pivot pin 24 is inserted through the extension members and thereby pivotally holds both the first and second jaws together. Each jaw member of the first and second jaws has a pointed extremity 26 and 28, respectively. Each jaw member further has an upper cam surface 30 and 32, respectively, as well as a lower cam surface 34 and 36, respectively. The upper and lower cam surfaces of each jaw member diverge from one another rearwardly from its pointed extremity toward its extension member, resulting in a generally wedge shape to the jaw members 12*a*, 12*b* and 14*a*, 14*b*. A spring steel member 38 resiliently biases each of the jaws so that the pointed extremities of the first and second jaws are separated from each other a distance at least equal to the diameter of the wire of a staple when the staple remover 10 is not being squeezed by a user.

One of the jaws is provided with a notch in the upper cam surface of each of its jaw members. In the drawings, each of the jaw members 12*a* and 12*b* has a notch 40 and 42 respectively. It is notable that the notch provisions could have been, alternatively, equally well provided in the jaw members 14*a* and 14*b*. It is seen from the figures that the notches 40 and 42 are located on the upper cam surfaces 30 at a location about midway between the pointed extremities 26 and the extension members 16. The exact location for a particular operation of the staple remover 10 according to the present invention will become apparent from the operational description hereinbelow. With particular reference to FIG. 3, the preferred configuration of the notches is shown. Each notch is identical; notch 42 is shown in FIG. 3 and is hereafter described in detail as representative of both notches. Notch 42 includes a first notch surface 44 which is oriented in a direction substantially parallel with the adjacent lower cam surface 34. The first notch surface 44 allows the staple 42 to slide into the notch 42 as the first and second jaws are squeezed together in the manner described hereinbelow for removing the staple from a stapled material. Each notch further includes a second notch surface 48 which is oriented in a direction which is substantially perpendicular to the adjacent lower cam surface 34. The second notch surface abuts the staple when the first and second jaws are squeezed in the manner described hereinbelow. In particular, the staple is gripped by the second notch surface 48 on one side and the upper cam surface 32 of the opposing jaw 14. This gripping action secures the staple for final removal from a stapled material, as disclosed hereinbelow. It is also possible to configure the second notch surface to have a concave or channel shape.

A concavely shaped second notch surface 48' is particularly shown in FIG. 8.

Operation of the staple remover 10 will now be described with reference to FIGS. 3 through 7.

To remove a staple 46 that is anchored in stapled materials 50, the staple remover 10 is positioned adjacent the staple in an orientation in which, as shown in FIGS. 3 and 4, the pointed extremities 26 and 28 face the staple and the lower cam surfaces 34 and 36 rest on the stapled materials. As shown in FIGS. 5 and 6, the first and second jaws 12 and 14 are squeezed together most comfortably by pressing each of the extension members 16 and 18 along the arrows A and B respectively. This squeezing causes the pointed extremities to enter between the staple 46 and the stapled materials 50. This entry includes the mutual action of the upper cam surfaces 30 and 32 as well as the lower cam surfaces 34 and 36 between the staple and the stapled materials. The inclined plane shape between the upper and lower cam surfaces causes the staple to be lifted from the stapled material at each of the staple ends, due to action of jaw members 12*a* and 14*a* at one end of the staple and jaw members 12*b* and 14*b* at the other end of the staple.

Before any one of the anchored ends of the staple can be pulled from the stapled materials, the aforesaid squeezing action results in the notches 40 and 42 eventually coming into contact with the staple. When this happens, the staple can no longer slide along the upper cam surfaces 30 and 32 in the manner of an inclined plane because the second notch surface 48 of each of the notches 40 and 42 prevent any further movement along the upper cam surface of jaw members 12*a* and 12*b*. Accordingly, further squeezing now only results in the staple being firmly gripped between the notches 40 and 42 and the upper cam surface 32 of the jaw members 14*a* and 14*b*. Now, to remove the staple completely from the stapled materials, the staple remover 10 is pulled away from the stapled materials in the direction of arrow C. The aforesaid gripping action, acting somewhat like pliers, ensures that the staple is completely and easily removed even if one end of the staple should pull free from the stapled materials before the other end does.

In this regard, it should be noted that one of the preferred forms of operation of the present invention is the removal of staples from stapled materials in which only one side of the staple has been freed from the stapled materials. To remove the staple, the staple is placed in the staple remover 10 so that one of the notches on one jaw will receive the staple as an upper cam surface of the other jaw bears against it as the staple remover is squeezed. All that is necessary then is to perform the aforesaid pulling movement to detach the staple from the stapled material.

It will be understood, therefore, that should one end of a staple pull free from a stapled material before the other end should pull free, that the aforesaid gripping action will permit the user to pull the staple free of the stapled material. In the prior art staple remover described hereinabove, since only an inclined plane function is possible, one end of the staple can easily pull free first creating a vexatious problem of removal. The present invention solves this problem by firstly limiting the extent to which the staple is removed from the stapled materials by action of an inclined plane and secondly by providing an assured gripping action by interaction of the notches of the upper cam surface of one jaw with the upper cam surface of the other jaw.

It is to be understood from the foregoing description of the invention and its operation, that the preferred location of the notches 40 and 42, is such as to provide a gripping action at some predetermined point in the squeezing process such that the staple will not have pulled free, by action of the upper and lower cam surfaces at either end thereof, from the stapled materials.

To those skilled in the art to which this invention appertains, the above described preferred embodiment may be subject to change or modification. For instance, a spring could be used in place of the spring steel member 38. Such changes or modifications can be carried out without departing from the scope of the invention which is intended to be limited only by the appended claims.

What is claimed is:

1. A staple remover for removing a staple from stapled material, said staple having a predetermined width, said staple remover comprising:

a first jaw having two first jaw members, each of said two first jaw members having an upper cam surface and a lower cam surface, said upper and lower cam surfaces of each of said two first jaw members conjoining to form a first pointed extremity, said upper and lower surfaces of each of said two first jaw members smoothly diverging from each other with increasing distance from said first pointed extremity, said two first jaw members being mutually separated a distance just less than said width of said staple;

a second jaw having two second jaw members, each of said two second jaw members having an upper cam surface and a lower cam surface, said upper and lower cam surfaces of each of said two second jaw members conjoining to form a second pointed extremity, said upper and lower surfaces of each of said two second jaw members smoothly diverging from each other with increasing distance from said second pointed extremity, said two second jaw members being mutually separated a distance just less than said distance of separation of said two first jaw members such that said two second jaw members may be inserted between said two first jaw members, said first pointed extremity of each of said first two jaw members facing said second pointed extremity of each of said second two jaw members;

pivoting means connected with said first jaw and said second jaw for pivotally connecting said first jaw with said second jaw so that said first extremity of each of said two first jaw members and said second extremity of each of said two second jaw members may be selectively squeezed together so that said two second jaw members may be inserted between said two first jaw members;

resiliency means for resiliently biasing said first extremity away from said second extremity, said resiliency means attaching to each of said first and second jaws on either side respectively of said pivoting means; and notch means located on each said upper cam surface of said first jaw members for receiving said staple after said first jaw and said second jaw have been squeezed together a predetermined amount, said notch means being located so as to receive said staple before said staple has been freed from said stapled material when said first and second jaws are forced between said staple and said stapled material by squeezing together of said first and second jaw, said staple contacting only each said upper cam surface of said second jaw members when said staple is received by said notch means, said notch means including a first notch surface which is substantially parallel in relation to said lower cam surface of said first jaw members, said notch means further including a second notch surface substantially perpendicular to said first notch surface for engaging said staple when said staple is received by said notch means.

2. The staple remover of claim 1, wherein said second notch surface of said notch means is concavely shaped.

* * * * *